US008312695B2

(12) United States Patent
Elsperger

(10) Patent No.: US 8,312,695 B2
(45) Date of Patent: Nov. 20, 2012

(54) APPARATUS AND METHOD FOR MAKING PACKS OF AT LEAST TWO CONTAINERS FOR BEVERAGES

(75) Inventor: Stefan Elsperger, Soechtenau (DE)

(73) Assignee: Krones AG, Neutraubling (DE)

( * ) Notice: Subject to any disclaimer, the term of this patent is extended or adjusted under 35 U.S.C. 154(b) by 439 days.

(21) Appl. No.: 12/641,673

(22) Filed: Dec. 18, 2009

(65) Prior Publication Data

US 2010/0154356 A1 Jun. 24, 2010

(30) Foreign Application Priority Data

Dec. 24, 2008 (DE) ..... 10 2008 063 082

(51) Int. Cl.
*B65B 17/02* (2006.01)
*B65B 27/04* (2006.01)

(52) U.S. Cl. ..... 53/398; 53/48.1

(58) Field of Classification Search ..... 53/398, 53/48.1; 206/151, 159; 294/87.2; *B65B 17/02, B65B 21/04, 21/06, 21/18, 21/20, 27/04*
See application file for complete search history.

(56) References Cited

U.S. PATENT DOCUMENTS

| | | | | | |
|---|---|---|---|---|---|
| 2,936,558 | A | * | 5/1960 | Glazer | 53/48.1 |
| 2,974,454 | A | * | 3/1961 | Andre et al. | 53/398 |
| 3,007,293 | A | * | 11/1961 | McGihon | 53/398 |
| 3,036,853 | A | | 5/1962 | Glazer | |
| 3,407,563 | A | * | 10/1968 | Dieter et al. | 53/398 |
| 3,474,590 | A | * | 10/1969 | Ganz | 53/398 |
| 3,611,656 | A | | 10/1971 | Chidsey, Jr. | |
| 3,777,450 | A | * | 12/1973 | De Shazor | 53/128.1 |
| 4,169,343 | A | * | 10/1979 | McArdle | 53/398 |
| 4,392,586 | A | | 7/1983 | Hartness et al. | |
| 4,817,361 | A | | 4/1989 | Cunningham | |
| 5,287,677 | A | | 2/1994 | Hunter | |

FOREIGN PATENT DOCUMENTS

| | | | |
|---|---|---|---|
| DE | 1256143 | | 12/1967 |
| DE | 3904566 | | 8/1989 |
| EP | 1340691 | A1 * | 9/2003 |
| EP | 1886921 | A1 * | 2/2008 |
| FR | 1465306 | A | 1/1967 |
| GB | 2023535 | A | 1/1980 |

OTHER PUBLICATIONS

Machine translation of EP1886921 retrieved from http://translationportal.epo.org/...RMAT=docdb&KIND=A1&LOCALE=en_EP&NUMBER=1886921&OPS=ops.epo.org&ENGINE=google&SRCLANG=de&TRGLANG=en, Apr. 30, 2012, 4 pages.*

* cited by examiner

*Primary Examiner* — Stephen F Gerrity
(74) *Attorney, Agent, or Firm* — Simpson & Simpson, PLLC

(57) ABSTRACT

An apparatus (2) and a method for making packs (30) of at least two beverage containers (20) are disclosed. Using a conveyor, (15) the beverage containers (20) are fed to a station (10), at which the beverage containers (20) can be guided into a separate holding element (16). The station (10) has at least two rigid guiding elements (50), which are positioned in the station in transport direction of the beverage containers (20) in such a way that they run towards each other and thus clamp the beverage containers (20) in the holding element (16).

16 Claims, 5 Drawing Sheets

APPARATUS AND METHOD FOR MAKING PACKS OF AT LEAST TWO CONTAINERS FOR BEVERAGES

CROSS-REFERENCE TO RELATED APPLICATIONS

This patent application claims priority of German Patent Application No. 10 2008 063 082, filed on Dec. 24, 2008, the application is incorporated herein by reference.

FIELD OF THE INVENTION

The present invention relates to an apparatus for making packs of at least two containers for beverages. The apparatus thereby comprises a conveyor means, which at least feeds the beverage containers to a station at which the beverage containers are guided into a separate holding element.

Likewise, the invention also discloses a method for making packs of at least two containers for beverages.

BACKGROUND OF THE INVENTION

U.S. Pat. No. 5,287,677 discloses an apparatus and a method with which bottles can be inserted into a carrying element. Capped bottles filled with a composition are loaded into pack carriers therefore in apparatus in which the bottles are conveyed in a continuous series in two spaced apart lines to respective metering starwheels, each with an associated application starwheel, and each starwheel with an associated retentive curved guide means along an arc thereof, at a loading zone while a continuous series of the pack carriers or clips are advanced on a conveyor between the bottle lines to the loading zone. At the loading zone the respective metering starwheels each move the bottles consecutively past the guide means to the associated application starwheel and the application starwheels are mutually spaced sufficiently close on either side of each pack carrier passing in between them to force successive bottles simultaneously from each line into the respective back to back pockets. The arms of the application starwheels during rotation act upon the pair of bottles just inserted to advance the pack carrier on a flat surface and index the pack carrier for the insertion of each successive back to back pair of bottles and then to move the loaded pack carrier to a discharge point or to another conveyor for further handling. The bottles during transport by the starwheels are carried thereby, the bottle rims just below the caps or other upper enlargements of the bottles resting on the upper edges of the starwheels. This can have a negative effect on the necessary flow rate of the apparatus. Furthermore, movable parts such as gear wheels are provided which push the bottles into the intended openings of the holding elements. The gear-shaped wheels can lead to a catching of the bottles. Likewise, it is not possible with the apparatus disclosed in the prior art to handle different bottle sizes.

U.S. Pat. No. 3,036,853 discloses several embodiments for a holding element and a carrier respectively for several bottles. The holding element/carrier thereby is provided with openings depending on the number of bottles to be carried, in which the bottles to be carried can be inserted. The document discloses not, however, on how an industrial usage of the mounting of the bottles is possible in the holding element/carrier.

BRIEF SUMMARY OF THE INVENTION

The object of the invention is to create an apparatus, which has minor downtimes to a reduced number of movable parts, and thereby nevertheless ensures a high flow rate. Likewise, the apparatus shall be adjusted simply and quickly to different forms and sizes of beverage containers which are to be clamped in a respective holding element.

The above object is achieved by an apparatus for making packs of at least two beverage containers comprising:

- a conveyor means;
- a station which receives said beverage containers fed by the conveyor means;
- a separate holding element into which the beverage containers are guided at the station; and
- at least two rigid guiding elements are positioned in the station in transport direction of the beverage containers so that two rigid guiding elements run to-wards each other and thus clamp the beverage containers in the holding element.

A further object of the invention is to create a method with which it is possible to form a pack of several beverage containers by using a reduced number of movable parts. Thereby, care must be taken that this method does not lead to any long downtimes of the apparatus according to the invention.

The above object is achieved by a method for making packs of at least two beverage containers, comprising the steps of:

feeding several beverage containers to a station by a conveyor means;

feeding also holding elements to the station, wherein in each case one holding element forms with several beverage containers a pack; and, providing at least two rigid guiding elements at the station which are oriented in a transport direction of the beverage containers such that the rigid guiding elements run towards each other and thereby pushing the beverage containers into the respective holding element of each pack.

The advantage of the apparatus for making packs of at least two beverage containers according to the invention is, that a conveyor means is provided, which at least feeds the beverage containers to a station. At the station, the beverage containers are guided to a separate holding element and are clamped to said separate holding element respectively. The station has at least two rigid guiding elements which are positioned in the station in transport direction of the beverage containers so that they run towards each other. By this special arrangement the beverage containers are thus clamped in the holding element.

The conveyor means also has a device for feeding the holding elements. The device for feeding the holding elements has at least one gripping element, which removes from at least one depot at least one holding element and feeds said holding element to the conveyor means.

The conveyor means has several feed elements for the holding elements in order to feed the holding elements to the station, where the beverage containers are clamped in the holding elements. The transport direction for the holding elements is essentially parallel to the transport direction for the containers for beverages.

On both sides of the station, a separating device for separating the packs is provided. For this purpose, several stops are provided which transport the packs in a clock wise manner to and through the station. The separating device for separating the packs is an endless belt with several stops separated from each other for the separation of the packs, and for the feed of the packs through the station.

Furthermore, the station is provided with a securing means which holds the beverage containers in the station definitely in place during the making of the respective pack. The securing means is also an endless belt with several securing elements thereon. The securing elements are put in the station onto the containers of beverages. After making the pack, the securing elements are again removed by the made packs by means of the endless belt.

It is particularly advantageous when the two guiding elements, which clamp the beverage containers into the holding elements, are rigid. Thereby, the round cross-section is of particular advantage, too. The round cross-section ensures that the guiding elements have no corners and rims which may lead to a damage of the beverage containers during their transport through the station.

Likewise, it is necessary, that a control is provided, which ensures that the conveyor means, the device for feeding the holding elements to the station, the separating device for separating the packs, wherein said separating device is provided on both sides of the station, and the securing means in the station are controlled such that the containers for beverages, the holding elements and the securing elements are provided in a clockwise manner.

It is of particular advantage that the conveyor means and the station which clamps the beverage containers in a separate holding element can be adjusted to different sizes and/or forms of the containers for beverages. Thereby, the beverage containers can be bottles or cans.

The advantageous method for making packs of at least two beverage containers is characterized by several steps. Firstly, several beverage containers are continuously fed to a station by a conveyor means. Likewise, holding elements are continuously fed in a clockwise manner to the station. Thereby, a holding element with several beverage containers in each case shall form a pack. The station itself is provided with at least two rigid guiding means, which are provided in transport direction of the beverage containers in such a way that they run towards each other in at least one section, so that the beverage containers can be clamped into the respective holding element and thus form the pack.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE INVENTION

Although the following description refers to bottles as containers for beverages, this shall not be regarded as limiting the invention. It is obvious for a person skilled in the art that with the apparatus according to the invention and with the method according to the invention respectively each type of beverage containers can be clamped in an accordingly designed holding element. Furthermore it is pointed out that same reference numbers refer to same elements throughout the various figures.

Figure 1:
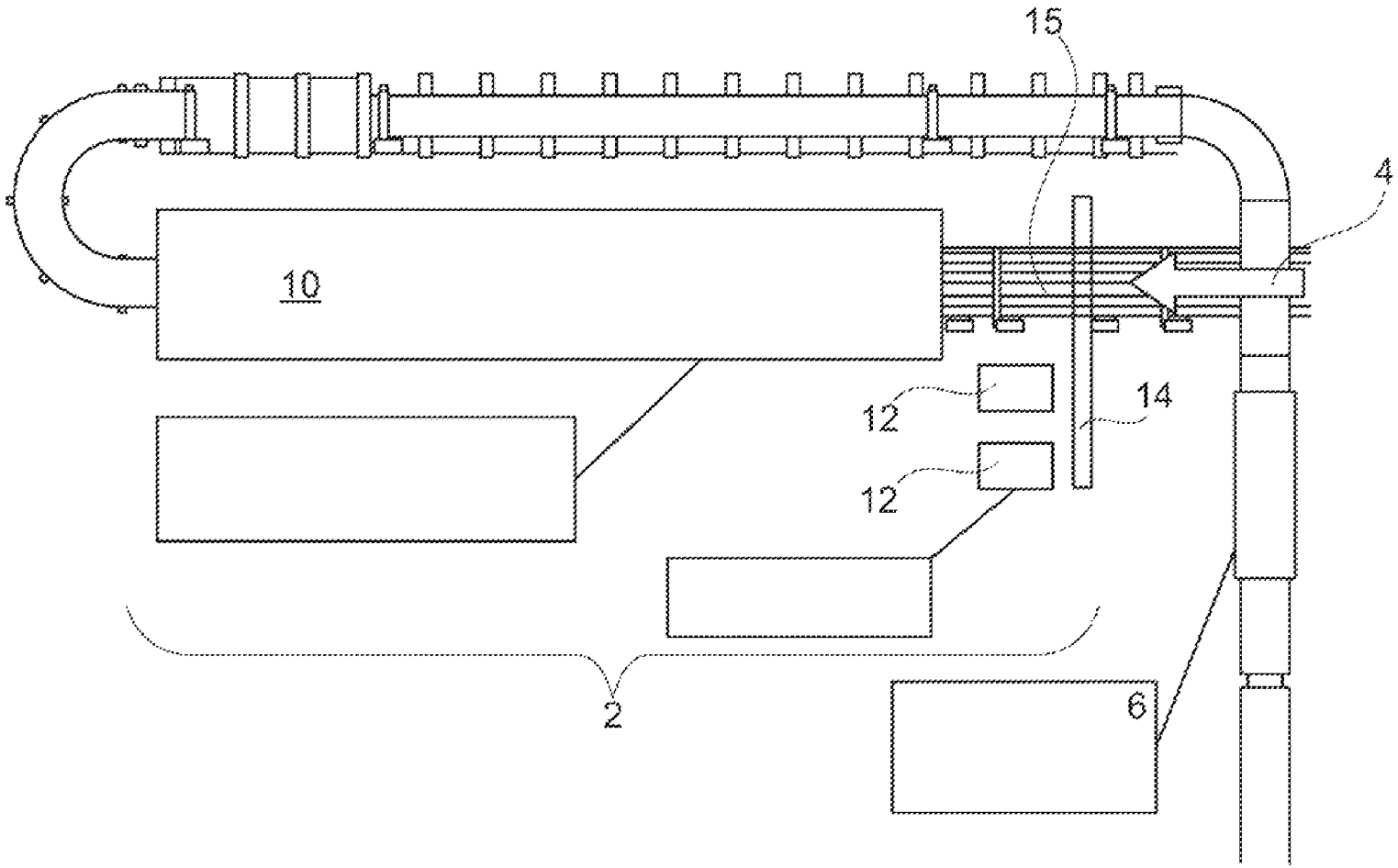
FIG. 1 shows a schematic view of a part of a bottling plant for beverage containers wherein it basically depends on the composition of the packs of containers of beverages. Here, also an apparatus for making packs of at least two beverage containers is also included.

FIG. 1 shows a schematic view of a portion of a bottling plant for liquids into bottles intended therefore, wherein the bottles, too, are arranged to respective packs. The bottling plant comprises an apparatus 2 for making packs of at least two bottles. The bottles are transported to the apparatus 2 from the direction marked with the arrow 4. Thereby, the apparatus 2 consists essentially of a station 10, in which the bottles are clamped in the individual holding elements. The packs are formed after the bottles having been clamped in individual holding elements. Likewise, the apparatus 2 has at least one depot 12 with the respective holding elements. From the depot 12 the holding elements are laid by a device for feeding the holding element onto the conveyor means 14, and said conveyor means 14 feeds afterwards the holding elements in a respective clockwise manner to the station 10. Furthermore, the apparatus can be provided with a labeling device 6 for preparing the individual labels onto the bottles. After the bottles having been clamped in the holding element, the labels are adjusted in the labeling device 6 in a respective predefined direction.

Figure 2:
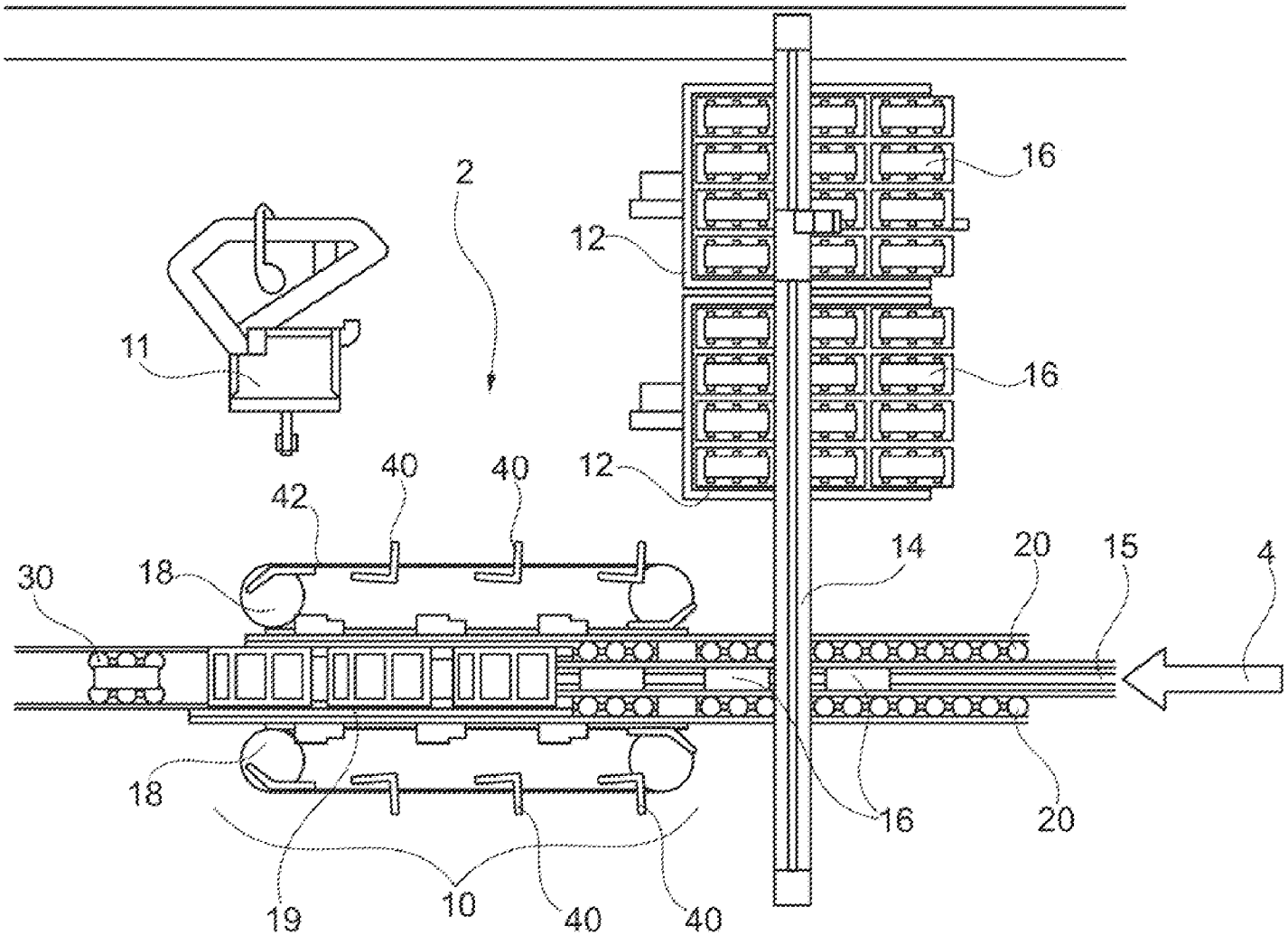
FIG. 2 shows a top view of the apparatus for making packs of at least two containers for beverages.

FIG. 2 shows a top view of the apparatus 2 for making packs 30 of at least two bottles 20. The bottles 20 are transported from the direction marked with the arrow 4 by a conveyor means 15. The conveyor means 15 serves also for transporting the bottles 20 through the apparatus 2. The conveyor means 15 also provides the bottles to the station 10, at which the bottles are clamped in holding elements 16. The holding elements 16 are also fed to the station 10 by the conveyor means 15. The holding elements 16 are laid by a device 14 for feeding the holding elements 16 onto the conveyor means 15. Thereby, the holding elements 16 are stored in at least one depot 12. The holding elements 16 are removed in a clockwise manner by the device 14 from the depot and laid onto the conveyor means 15. The station 10 is provided with a separating device 18 for separating the packs 30, wherein said separating device 18 is provided on both sides of the conveying direction of the bottles. The bottles incoming into the apparatus 2 are separated by the separating device 18 according to the necessary pack size. The bottles 20 separated individually according to the pack size and are thus feed into the station 10, in which the clamping of the bottles 20 onto the respective holding element 16 is carried out. The separating device 18 for separating packs is an endless belt 42 with several stops 40, with which the bottles and unfinished packs respectively can be transported through and to the station 10 respectively on both sides of the transport direction 15 in each case. The stops 40 thus constitute a feed and certain timing for the transport of the bottles and packs respectively through the station 10. The apparatus 2 is also provided with a control 11 which ensures that the conveyor means 15, the device 14 for feeding the holding elements to the station 10, the separating devices 18 for separating the packs, wherein said separating devices are intended on both sides of the station 10, and the securing means 19 in the station 10 are controlled such that the bottles 20, the holding elements 19 and the securing means are provided in a clockwise manner. The control 11 can thereby be designed as a touch screen or as a conventional input device (keyboard, mouse, joystick).

Figure 3:
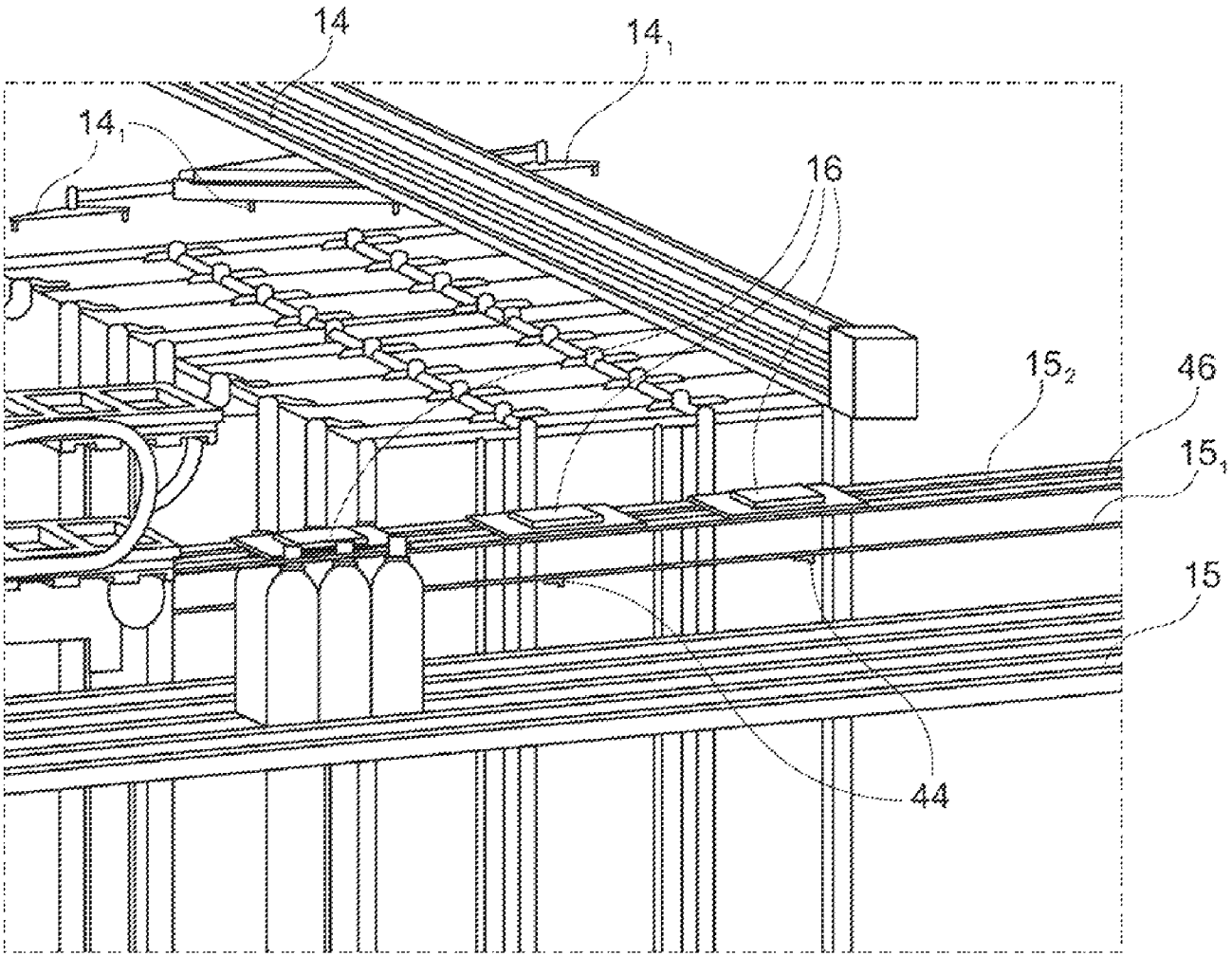
FIG. 3 shows a perspective detailed view of the portion of the apparatus for making packs of at least two containers for beverages, in which several holding elements are removed from a depot.

FIG. 3 shows a perspective detailed view of the portion of the apparatus 2, where the holding elements 16 are laid onto the conveyor means 15. The conveyor means 15 comprises in addition a traction mechanism 151, at which stops 44 are provided in defined spacing. The stops 44 serve for the support of the feed of the bottles 20 in direction to the station 10. Furthermore, the transport device 15 comprises a transport system 152 for the holding elements 16. Likewise, the system 152 comprises respective stops 46, in order to transport the holding elements 16 in defined spacing also under consideration of the spacing of the bottles 20 to the station 10. As already mentioned, the holding elements 16 are transported by a device for feeding the holding elements onto the conveyor means 15. Thereby, the device 14 comprises at least one gripping element 141, which removes in each case a holding element 16 from the depot 12 and lays said holding element 16 in a respective manner onto the conveyor means 15, and the system for the transport of the holding elements 16 respectively.

Figure 4:
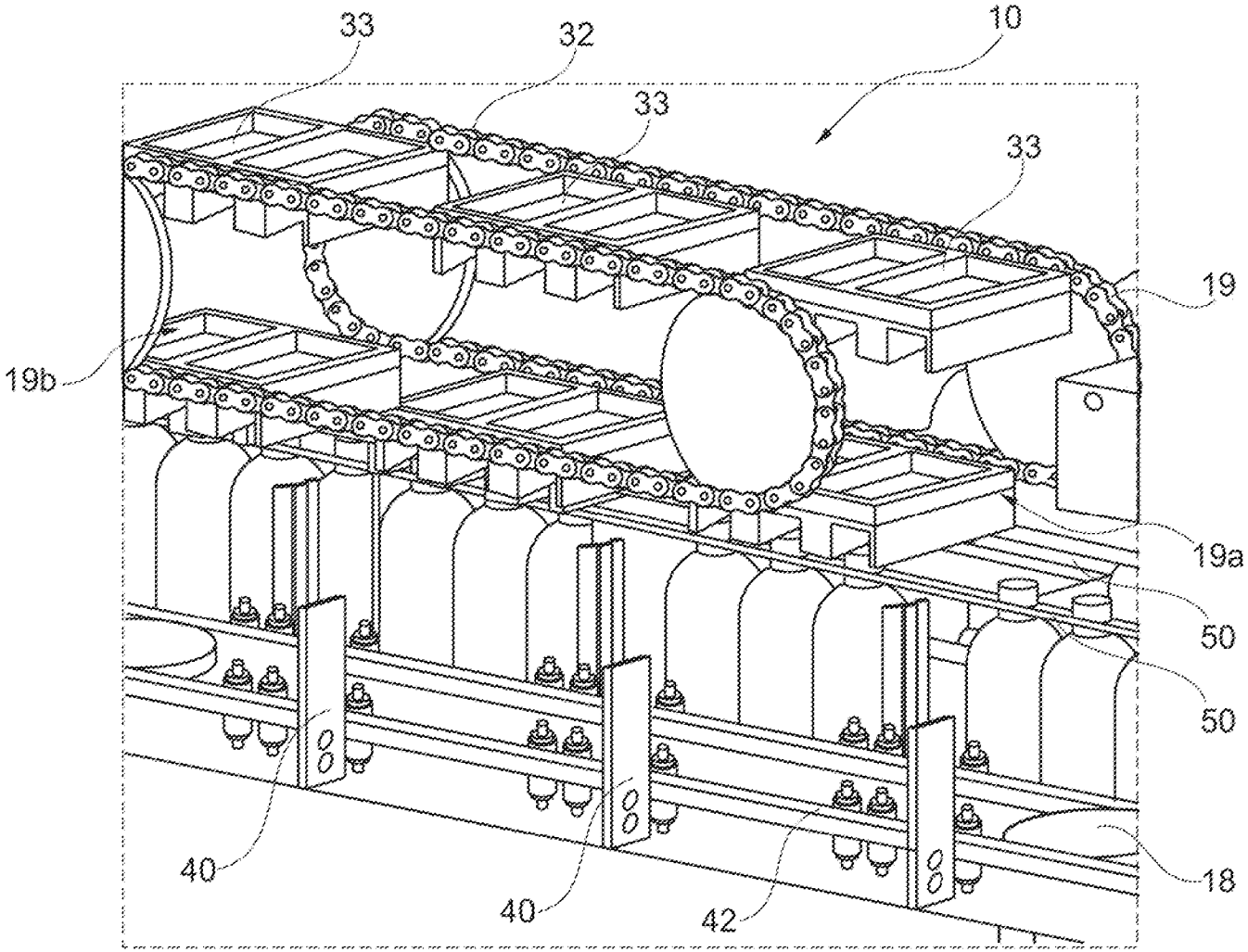
FIG. 4 shows a perspective detailed view of the station in which the beverage containers are clamped in the holding elements; and, FIG. 5 shows a schematic top view of the station with which the beverage containers are clamped into the holding elements.

FIG. 4 shows a perspective detailed view of the station 10, in which the bottles 20 with the holding elements 16 are assembled to the respective packs. As already mentioned, the separating device 18 for separating the packs is intended on both sides of the transport direction for the bottles 20. The separating device 18 is an endless belt 42 with several stops 40 separated from each other thereon. The stops 40 serve for transporting the bottles 20 and the bottles 20 already assembled to the individual packs respectively in a clockwise manner through the station 10. Furthermore, the stops 40 provide a certain feed for the transport of the bottles. Thereby, the endless belt 42 can have several embodiments. One possible embodiment is that the endless belt 42 is a chain. The station 10 is also provided with a securing means 19. The securing means 19 serves in the station 10 for holding the bottles 20 and the bottles already assembled to the packs respectively during the making of the respective pack and during the clamping of the respective bottle about the respective holding element respectively in position. The securing means 19 comprises an endless belt 32 with several securing means 33 thereon. It is obvious for a skilled person that the endless belt 32 can have several embodiments. In a preferred embodiment the endless belt 32 is designed as a chain 32 as well. In the way, in which the packs and bottles 20 respectively are fed into the station 10, the holding elements 16, too, are fed into the station 10. Parallel to the aforesaid, the securing elements 33 of the securing means 19 are clamped in the same clockwise manner onto the individual bottles and temporarily assembled packs respectively. Guiding elements 50 are in each case provided for lateral guiding of the bottles 20 and packs respectively in the station 10 on both sides of the bottles to be transported. These guiding elements 50 are preferably designed as bars. A round cross-section of the guiding elements 50 is thereby particularly preferred.

Figure 5:
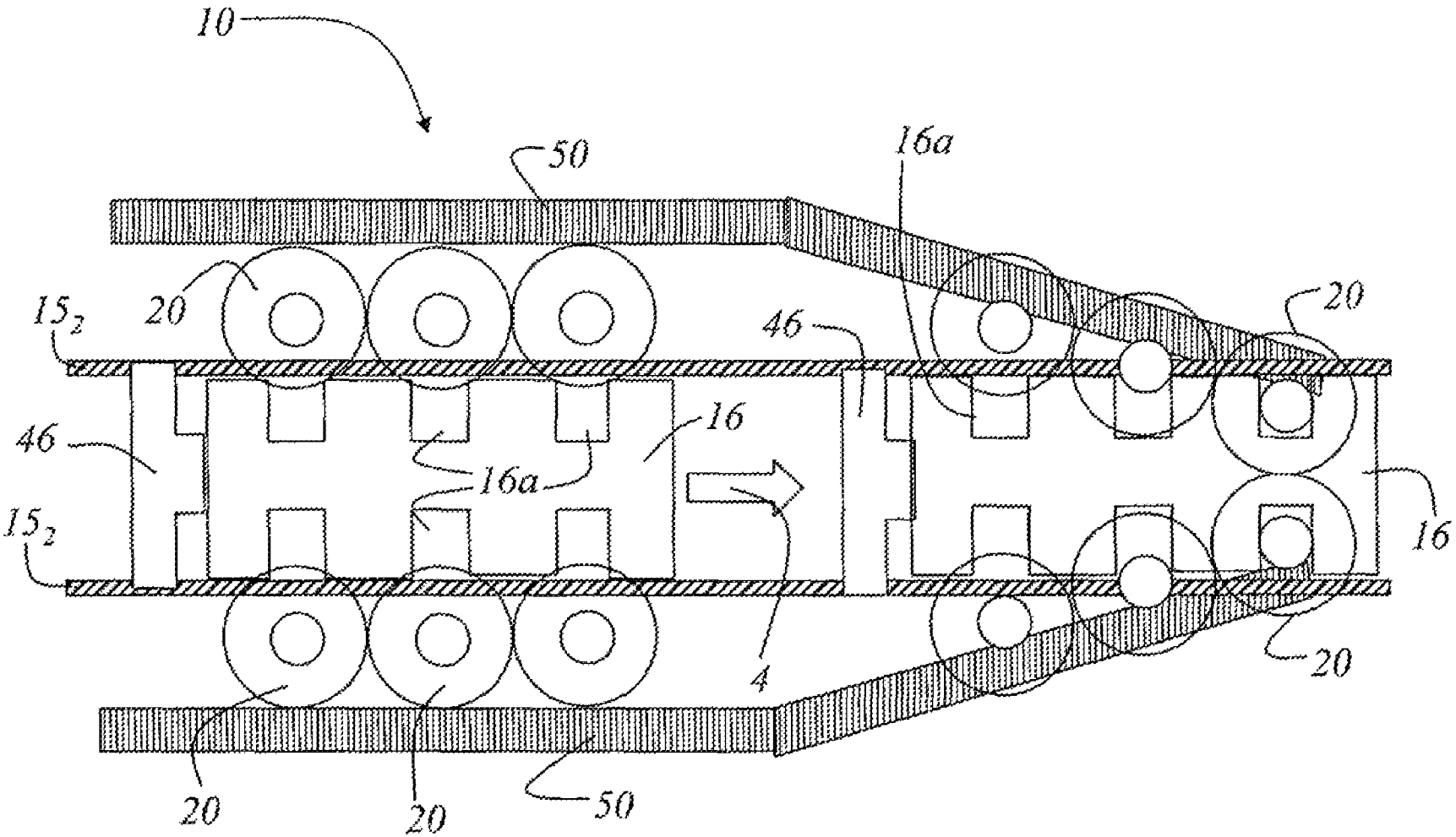

FIG. 5 shows a schematic top view of the station 10 where the bottles 20 are clamped into the holding elements 16. The bottles 20 are transported along the transport direction 4 drawn in FIG. 5 through the above-mentioned conveyor means 15. Thereby, the individual bottles are already separated to the respective intended packs, which should finally be clamped in the holding element 16. The holding elements 16 are transported by a conveyor means 152 with stops 46 in direction of that position of the station 10, at which the bottles 20 are clamped into the holding elements 16. The bottles 20 are provided with a lateral guiding which is designed as guiding elements 50. Said guiding elements 50 are positioned on both sides of the bottles 20 in transport direction. At least one portion of the guiding elements 50 is designed as running towards each other. By this running towards each other the bottles 20 are pushed in a respective manner into the openings 16*a* of the holding elements 16. The bottles 20 are thus held in the openings 16*a* securely and can thereby be transported.

Thus, it is seen that the objects of the present invention are efficiently obtained, although modifications and changes to the invention should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention.

What is claimed is:

1. An apparatus for making packs of at least two beverage containers comprising:

a conveyor means, for feeding the at least two beverage containers;

a station which receives said at least two beverage containers fed by the conveyor means;

a separate holding element into which the at least two beverage containers are guided at the station;

at least two rigid guiding elements are positioned in the station in a transport direction of the at least two beverage containers so that two rigid guiding elements run towards each other; and a securing means with several securing elements, which hold the at least two beverage containers in the station in place while the two rigid guiding elements clamp the at least two beverage containers in the holding element.

2. The apparatus recited in claim 1, wherein the conveyor means has a device for feeding the holding element.

3. The apparatus recited in claim 2, wherein the device for feeding the holding element has at least one gripping element, which removes from an at least one depot at least one holding element and feeds said holding element to the conveyor means.

4. The apparatus recited in claim 3, wherein the conveyor means has several feed elements for the holding elements, wherein a transport direction for the holding elements prior to the station is substantially parallel to the transport direction for the beverage containers.

5. The apparatus recited in claim 1, wherein the station has on both sides a separating device for separating the packs, wherein said separating device is provided with several stops, in order to transport the packs using an endless belt to and through the station.

6. The apparatus recited in claim 5, wherein the separating device for separating the packs is an endless belt with several stops separated from each other for the separation of the packs, and for the feed of the packs through the station.

7. The apparatus recited in claim 1, wherein the securing means is an endless belt, at which several securing elements are provided, which are put in the station in each case on one end onto the beverage containers of the pack and are removable again at the other end after finalizing the pack.

8. The apparatus recited in claim 1, wherein the two rigid guiding elements are bars with a round cross-section.

9. The apparatus recited in claim 1, wherein a control is provided which ensures that the conveyor means, a device for feeding the holding element to the station, a plurality of separating elements for separating each one of a plurality packs of at least two beverage containers, wherein each one of said plurality of separating elements are provided on both sides of the station, and the securing means in the station are controlled such that the containers for beverages, the holding elements and the securing means are provided on a plurality of endless belts.

10. The apparatus recited in claim 1, wherein the conveyor means and the station, which attaches the beverage containers in a separate holding element, are adjustable to different sizes and/or forms of the containers of beverages.

11. The apparatus recited in claim 1, wherein the beverage containers are bottles or cans.

12. A method for making packs of at least two beverage containers, comprising the steps of:

feeding several beverage containers to a station by a conveyor means;

feeding holding elements to the station, wherein in each case one holding element forms a pack with the at least two beverage containers;

providing at least two rigid guiding elements at the station which are oriented in a transport direction of the beverage containers such that the rigid guiding elements run towards each other; and, holding the at least two beverage containers in place with a securing element of a securing means while the two rigid guiding elements push and clamp the the beverage containers into the respective holding element of each pack.

13. The method recited in claim 12, wherein a device for feeding the holding element is provided, with which the holding elements are positioned in the conveyor means.

14. The method recited in claim 12, wherein the station is provided on both sides with a separating device for separating the packs, wherein said separating device is in each case provided with several stops so that the packs are transported to and through the station on an endless belt.

15. The method recited in claim 12, wherein the securing means is an endless belt at which several securing elements are provided, which are put on in the station in each case on one end onto the beverage containers the pack and are removable again at the other end after making the pack.

16. The method recited in claim 12, wherein the conveyor means and the station, in which the beverage containers are pushed and clamped in a separate holding element, are adjustable to different sizes and/or forms of the beverage containers.

* * * * *